US005595554A

United States Patent [19]

Maresh

[11] Patent Number: 5,595,554

[45] Date of Patent: Jan. 21, 1997

[54] ROTO STEPPER EXERCISE MACHINE

[76] Inventor: Joseph D. Maresh, 19919 White Cloud Cir., West Linn, Oreg. 97068

[21] Appl. No.: 287,526

[22] Filed: Aug. 8, 1994

Related U.S. Application Data

[63] Continuation-in-part of Ser. No. 221,529, Apr. 1, 1994, abandoned.

[51] Int. Cl.[6] ..... A63B 22/04

[52] U.S. Cl. ..... 482/52; 482/53; 482/71

[58] Field of Search ..... 482/51, 52, 53, 482/72, 71, 110, 112, 113, 148, 908, 142–144

[56] References Cited

U.S. PATENT DOCUMENTS

| | | | |
|---|---|---|---|
| 3,213,852 | 10/1965 | Zent | 482/62 |
| 4,657,244 | 4/1987 | Ross . | |
| 4,708,338 | 11/1987 | Potts | 482/52 |
| 4,838,544 | 6/1989 | Sasakawa et al. . | |
| 4,895,362 | 1/1990 | Ross . | |
| 4,917,376 | 4/1990 | Lo . | |
| 5,031,902 | 7/1991 | Findlay . | |
| 5,035,417 | 7/1991 | Ross . | |
| 5,211,613 | 5/1993 | Friesl | 482/62 |
| 5,238,462 | 8/1993 | Cinke | 482/51 |
| 5,299,993 | 4/1994 | Habing | 482/52 |
| 5,308,300 | 5/1995 | Chino et al. | 482/52 |
| 5,314,392 | 5/1994 | Hawkins et al. | 482/54 |

FOREIGN PATENT DOCUMENTS

| | | | |
|---|---|---|---|
| 1493270 | 7/1989 | U.S.S.R. | 482/54 |

*Primary Examiner*—Jerome Donnelly

[57] ABSTRACT

An exercise machine designed to condition the lower body comprising a pair of foot receiving platforms which may be established to travel along circular paths following coordinates in all three spacial dimensions—longitudinal, lateral, and vertical. The circular paths which the foot platforms travel along may also be established to be coplanar, inclined, counter rotating, and overlapping; while constraining the foot platforms which cyclically travel along the path to remain mutually parallel and at constant lateral separation. A flywheel and/or frictional resisting means may be incorporated as desired.

20 Claims, 10 Drawing Sheets

ROTO STEPPER EXERCISE MACHINE

REFERENCE TO CO-PENDING RELATED APPLICATION

This application is a continuation-in-part of Ser. No. 8/221,529 filed Apr. 1, 1994 now abandoned.

BACKGROUND

1. Field of Invention

This invention pertains to an exercise machine, of a type designed to exercise lower body muscles. The resisting motion to which the lower body is subjected to when using this machine is unique, and may perhaps be best characterized as a combination of the resisting motions that would be experienced during the use of a bicycle, a stair stepper, and a skiing machine.

2. Description of Prior Art

The market is replete with exercise machines designed to exercise various muscle groups in the human body. Three popular categories of exercise machines designed to exercise the lower body are bicycle machines, stair steppers, and skiing machines. These machines have been successful because they offer an effective form of an aerobic, low impact exercise.

Bicycle machines provide resistance to leg motion by causing two foot petals, which receive the feet of the user, to each resistively travel along a circular path, mutually in the same direction, about a coaxial, horizontal axis of rotation, while maintaining the pedals diametrically opposite and with constant lateral distance between them.

Stair steppers provide resistance to leg motion such that work is performed during the unbending (or straightening) of each leg as two pedals or foot platforms are continuously and alternatively stepped upon and released.

Skiing machines offer resistance to leg motion by allowing two foot platforms to alternately travel rearward with resistance and forward with minimal resistance in a linear side by side manner. During use, dependent upon the specific machine design, the two foot platforms may have to be continuously coordinated and synchronized by the user to be out of phase with each other by half of a cycle.

OBJECTS AND ADVANTAGES OF THE PRESENT INVENTION

This invention resistively subjects the lower body to a unique motion of greater complexity than any of the three categories of exercise machines described above. In terms of spatial geometry, each of the three categories of prior art machines described above may be referred to as two dimensional exercise machines; the bicycle machine with the pedals that rotate about a singular axis thereby causing the operators feet to move forward and back (longitudinal) for the first dimension, and up and down (vertical) for the second dimension; the stair stepper with the foot platforms which generally travel along an arcuate path about a singular, horizontal axis of pivotation, which causes the operators feet to move forward and back (longitudinal) to a minimal degree for the first dimension, and up and down (vertical) to a major degree for the second dimension; and the skiing machine with its linear, reciprocating foot platform motion that causes the feet to move forward and back (longitudinal) for the first and only direction. Thus, each of those machines only cause the foot platforms to move, at most, in two dimensions. The present invention uniquely operates the foot platforms in all three dimensions of spatial geometry, longitudinal, vertical, and transverse, thus enabling the user to exercise additional body muscles to achieve better results. The inventor, being a picture of fitness, recommends the use of this device as a challenging form of exercise.

SUMMARY OF THE INVENTION

In accordance with the preferred embodiment of this invention, two foot platform support members, each with their own distinct axis of rotation, has a foot platform rotatably installed at an outer end. The centerline distance between the axes of rotation of each of these foot platform support members, in conjunction with the magnitude of eccentricity of the foot platform support member outer ends, may be established to effect ideal operational characteristics. In the embodiments to be shown, the circular paths that the foot platforms are forced to travel along has been established to be overlapping, with minimal lateral separation, and with what the inventor considers to be the optimum diameter and inclination angle; but as the reader may surmise, these and other variables may be juggled to arrive at distinct operational characteristics. Additionally, a mechanical component may be incorporated upon this machine such that the two foot platforms are forced to remain parallel with respect to each other at all times.

The overlapping circular paths that the foot platforms are forced to travel along are preferably inclined in order to establish the three dimensional operational characteristics. The platform support members, as in the case with the embodiments to be illustrated, may consist of tubular members bent at inner and outer distal ends to approximately thirty degrees. Support bearings are installed at the inner ends of these tubular members to provide means for the tubes to rotate. During use, the two platform support members are preferably synchronized by connected mechanical components such that they are maintained out of phase with each other by one half of a cycle or 180 degrees in counter rotational directions. The simplest and least expensive means to ensure synchronization is to install a pair of intermeshing gears or toothed wheels onto the two platform support tubes, in proximity to the support bearings. If parallelism constancy between the two platform is desired, an optional foot platform orientation member, contained within each platform support tube, may be connected nonrotatably relative to the machine frame at an inner distal end, and nonrotatably at an outer distal end to each respective rotatably mounted foot platform. The method chosen to prevent the orientation member from rotating about its longitudinal axis must however allow pivotation or longitudinal angular misalignment at the distal end connections. The nonrotating foot platform orientation members employed within the platform support tube may for example consist of shafting with U-joints, flexible drive cable, flexible couplings, bevel or hinged gears, or a slotted or solid rigid bar with torque receiving members at each distal end. In order to provide inertial characteristics during operation, a mechanical flywheel, with its respective driven pulley, may be optionally installed remote from the platform support members, and belt or chain driven by a drive pulley secured at an inner end to one of the rotatable platform support members. If frictional resistance is desired, a fan may be used in place of the flywheel; or an adjustable friction brake may be installed to actuate upon the flywheel, the gears, or even directly upon the foot platform support tube. Additionally, if a mechanical flywheel is installed, an overrunning clutch may, for example, be located between a driven platform support member and the flywheel drive pulley so as to allow the operator to cease motion of the foot platforms without the consequence of having to exert force to stop the flywheel. It should be noted that by providing a bidirectional, mode convertible one way clutch to the flywheel, the user would be able to operate the foot platforms in either counter rotating direction. Of course, an artificial flywheel, such as electronic, would in many respects simplify the mechanism.

In describing the three spatial dimensions (or albeit somewhat inaccurately: degrees of freedom) that the operator will experience, the first spatial dimension corresponds to the forward and back (longitudinal) motion as the foot pedals travel along their inclined circular paths. The magnitude of this first dimension is inversely proportional to the angle to which the plane defining the circular path has been inclined rearwardly from horizontal. The second spatial dimension corresponds to up and down (vertical) motion as the foot platforms travel along their inclined circular paths. The magnitude of this second dimension is directly proportional to the rearward inclination angle of the circular path plane, and as follows, would be zero if the path is level. The third and final spacial dimension corresponds to side to side (transverse) motion as the foot platforms travel along their circular path, and, because the path plane has not been inclined transversely, the magnitude of this third dimension is not a function of the degree to which the path angle has been rearwardly inclined.

In describing how one would exercise with this machine, note that, unique to this machine, it is preferable from a balance and coordination aspect to have the foot platforms rotate at the same angular velocity, with respect to each other, in a counter rotating manner; although it would be possible to operate this machine if they rotate in the same direction. Within the counter rotating mode, two separate directional distinctions are possible; that which causes the foot platforms to pass down between the tubular axes of rotation, at the transverse center of the machine, or that which causes each of the foot platforms to pass down at their respective outer transverse side of the machine. Counter rotating the foot platforms such that they pass down at the transverse central region of the machine will ensure that the operator's feet will effortlessly remain situated on the foot platforms, without the necessity of foot straps and the like. Counter rotating the foot platforms such that they pass down at their respective outer transverse side of the machine may be desirable to work different muscles, and result in a more demanding exercise. It may also be noted that although this machine is illustrated with the intent that the operator face forward, a beneficial effect would also be derived if the foot platforms are alternatively designed to accommodate the user to stand facing rearward as well. Such a design modification may for example entail centralizing the optional foot straps, or providing means for the foot platforms to be longitudinally reversed.

These and other advantages or objects of the invention will become apparent upon consideration of the following detailed description along with the attached drawings, in which.

DESCRIPTION OF THE PREFERRED EMBODIMENTS

Figure 1:
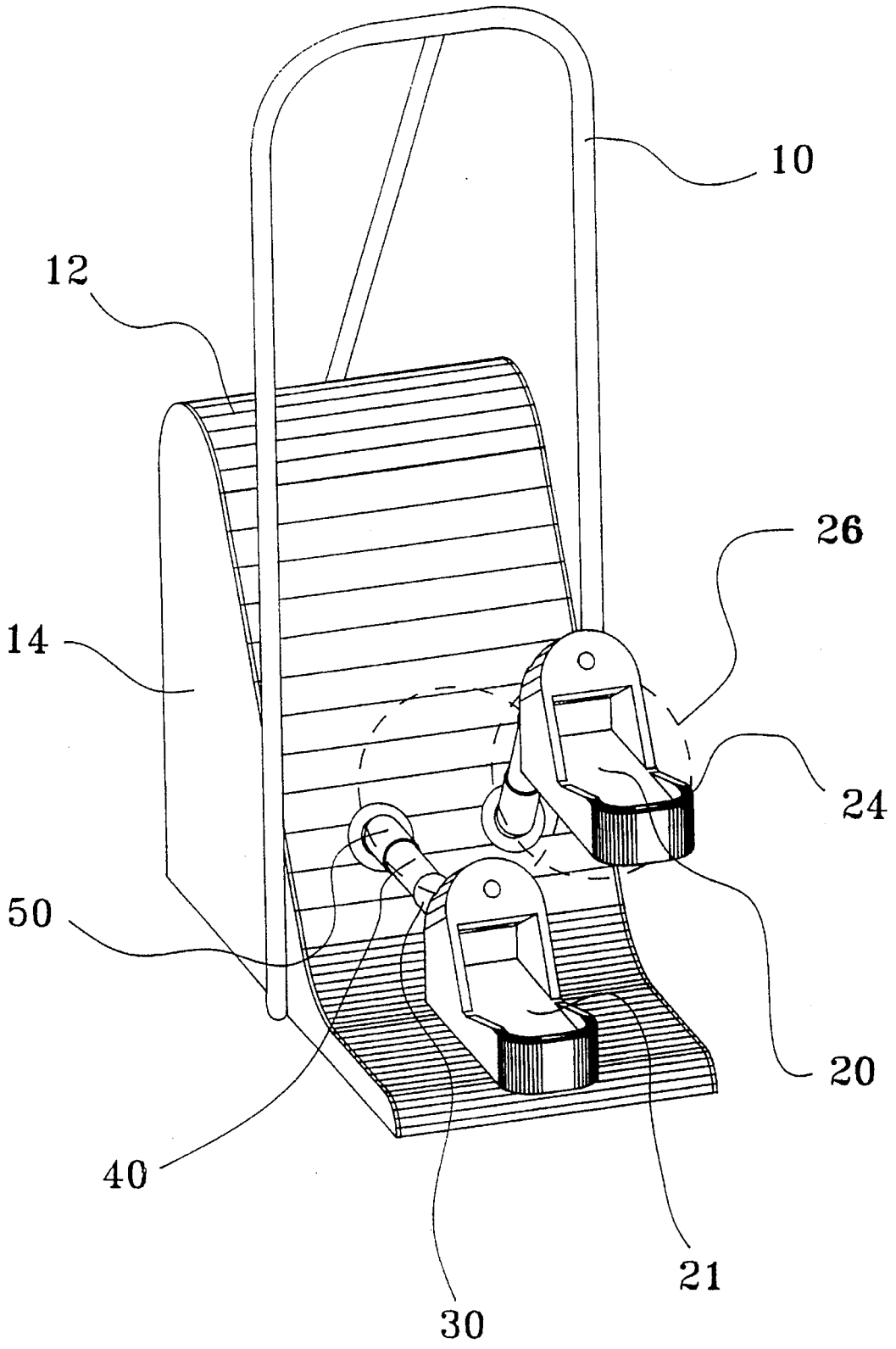
FIG. 1 is an assembled front perspective view of a non-collapsible version of the exercise machine.

Referring now to the figures, I have illustrated in FIG. 1 a front perspective view of the assembled machine, where foot platform 20, with heel stop 24, is shown to present a level platform upon which the operator's right foot is to be placed. The circular path 26, about which the right foot platform 20 will travel during operation, is inclined rearward sixty degrees from horizontal, and is represented with a dashed line. The right foot platform 20 is illustrated at its uppermost position along this travel path. The left foot platform 21 is illustrated at the lowermost position along its travel path. The tubular members supporting the foot platforms each consist of three portions; an outer thirty degree tubular elbow 30, an intermediate tube 40, and inner thirty degree tubular elbow 50. Housing side 14, housing shroud 12, and handle bar 10 encloses most of the mechanism, and enable the operator to safely operate the machine. It may be noted that the stationary handle bar may be replaced with handles which move under resistance, if an upper body workout is also desired. Such handles may for example pivot about an axis perpendicular to the side of the machine, and be bent such that the hand grips are located at a comfortable position to operate. Because various designs of upper body workout handles, poles, or cranks or levers are incorporated upon many different categories of exercise machines, the potential for including any one of them upon this machine is considered obvious.

Figure 2:
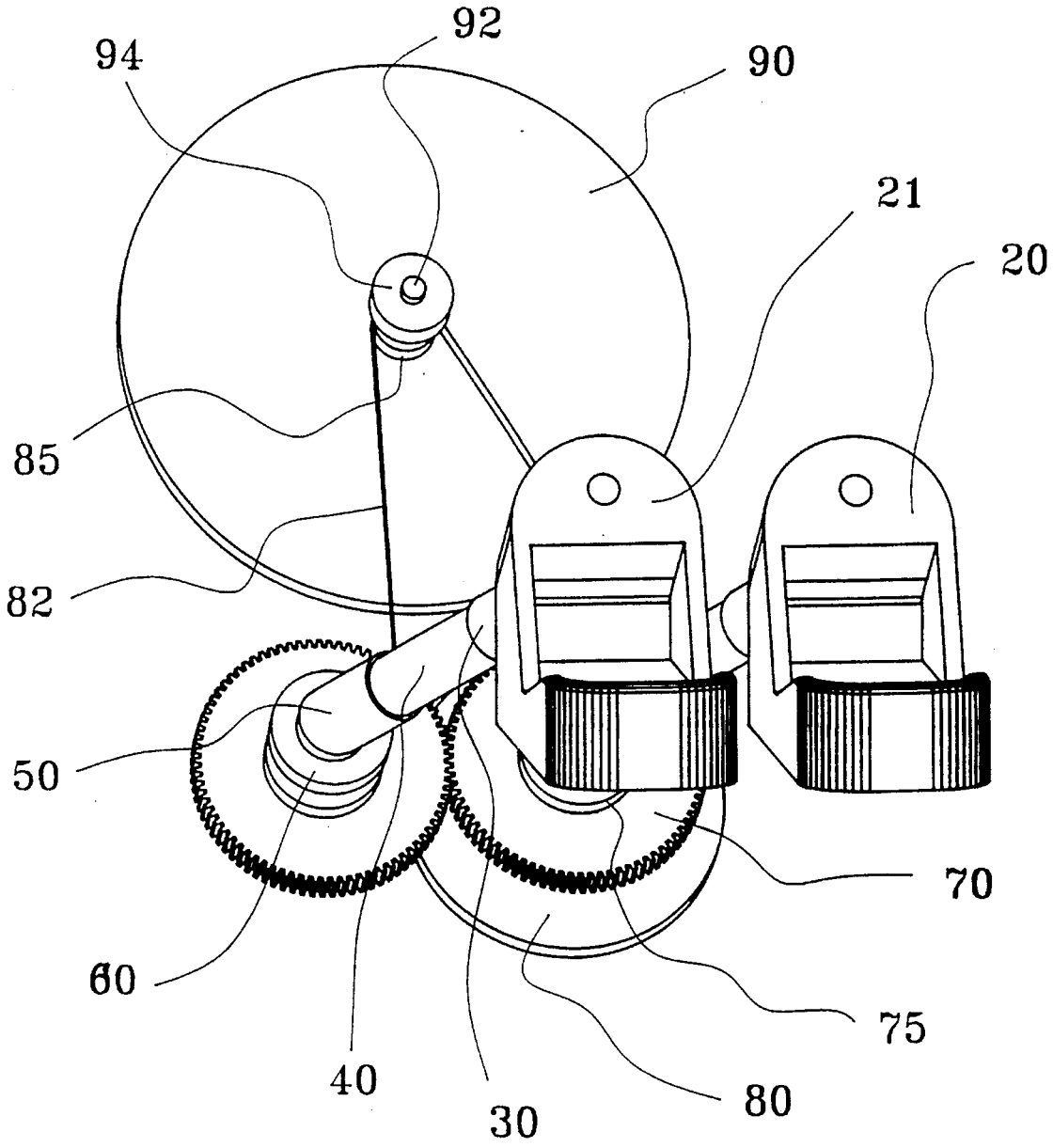
FIG. 2 is a frontal perspective view of one embodiment of the assembly mechanism removed from the housing of the machine, and includes an optional flywheel.

Referring now to FIG. 2, a frontal perspective view is illustrated of most of the portions of the mechanism that would be visible, if the housing of the machine was to be removed. Right foot platform 20 and left foot platform 21 are each shown oriented at the three o'clock position. Because each of the rotating platform support members rotates about their respective tube support bearings 60, and because the counter rotating gears 70 are in mesh with one another, as right foot platform 20 moves upward, left foot platform 21 will simultaneously move downward. Gear hub 75 secures gear 70 in a fixedly manner to inner tubular elbow 50. It may be noted that, if gears or toothed wheels are employed to provide the means to cause the platform support members to synchronously counter rotate, they may be constructed of plastic due to low torque requirements. Furthermore, although a pair of gears are illustrated, it would be obvious to the reader that any number of gear pairs would establish the same counter rotational action. Continuing now, flywheel drive pulley 80 is fixedly secured to inner tubular elbow 50, and drives flywheel driven pulley 85. Flywheel 90 is rotationally secured by flywheel shaft 92, said shaft being rotatably secured at one end by flywheel bearing 94. Flywheel drive member 82 may an endless 'V' belt, a timing belt, or a roller chain. Flywheel drive pulley 80 may therefore alternatively be of a sprocket design. As indicated earlier, the installation of a flywheel may be considered optional.

Continuing with FIG. 2, a hidden set of tube support bearings are installed away from the viewer, on the opposite side of the counter rotating gears 70. Also, any optional mechanisms contained within the tubular support, or protruding out of and/or attached to each distal end of the tubular supports are not illustrated.

Figure 3:
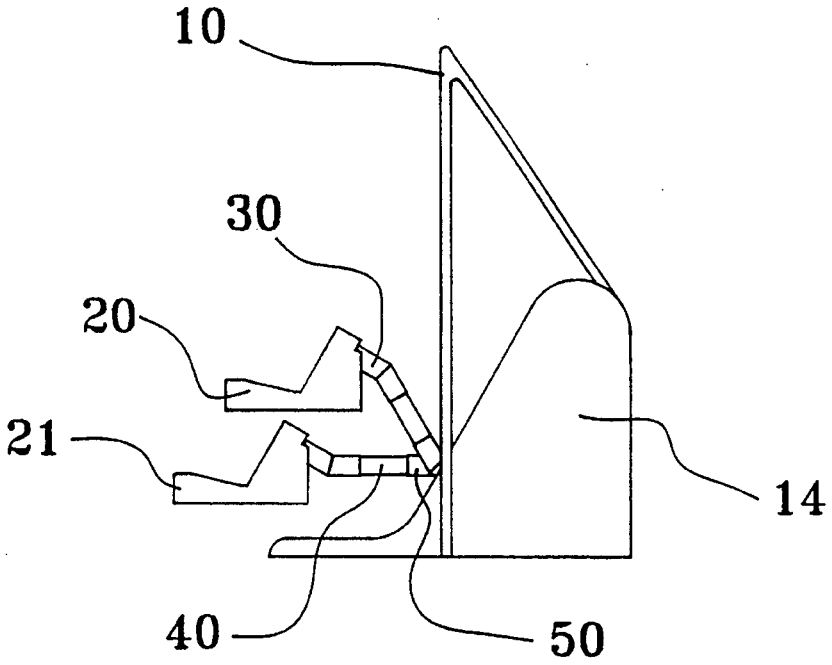
FIG. 3 is a side plan view of the assembled machine of FIG. 1 with the foot platforms at the twelve o'clock and six o'clock positions. The foot contact areas of the foot platforms in this figure are located below the foot platform rotational axis with respect to gravity.

Directing the reader's attention to FIG. 3, a side plan view is shown of the assembled machine. Handle bar 10 is secured to housing side 14 to provide a hand grip surface for safety purposes. Right foot platform 20 is shown as it would appear in this view if it was oriented at the twelve o'clock position, while left foot platform 21 is oriented at the six o'clock position. Both foot platforms are of a design which locates the platform rotational axis above the foot contact area with respect to gravity. This allows the foot platforms to hang in a downward position if platform orientation members are not provided. Intermediate tube 40 is threaded into outer tubular elbow 30 and also into inner tubular elbow 50.

Referring now to FIG. 4, a side view is again shown, but in this view the right foot platform 18, as well as the left foot platform, are orientated at the three o'clock position. The left foot platform is therefore hidden from this view. Connected to right foot platform 18, and protruding out of outer thirty degree elbow 30 is outer synchronous shaft 25. Outer synchronous shaft 25 is maintained nonrotatable relative to the machine frame, and also nonrotatably relative to foot platform 18, and therefore maintains constant orientation of its respective foot platform as the foot platform travels along its circular path. It may be noted that if it is desired to make the inclination angle of the paths of the foot platforms adjustable, the function of the orientation members is unchanged. A foot platform orientation member is required with the design of the foot platform illustrated in this figure because the design of the foot platform illustrated in this figure is such that the foot platform 18 rotational axis is positioned below the foot platform foot contact area with respect to gravity. Foot platform orientation members are not required if the platform rotational axis is positioned above the foot platform foot contact area. Intermediate tube 40, outer tubular elbow 30, and inner tubular elbow 50 assemble to form the platform support member. Section line 6—6, taken at a central plane of the tubular platform support members will reveal additional detail in FIG. 6.

Figure 5:
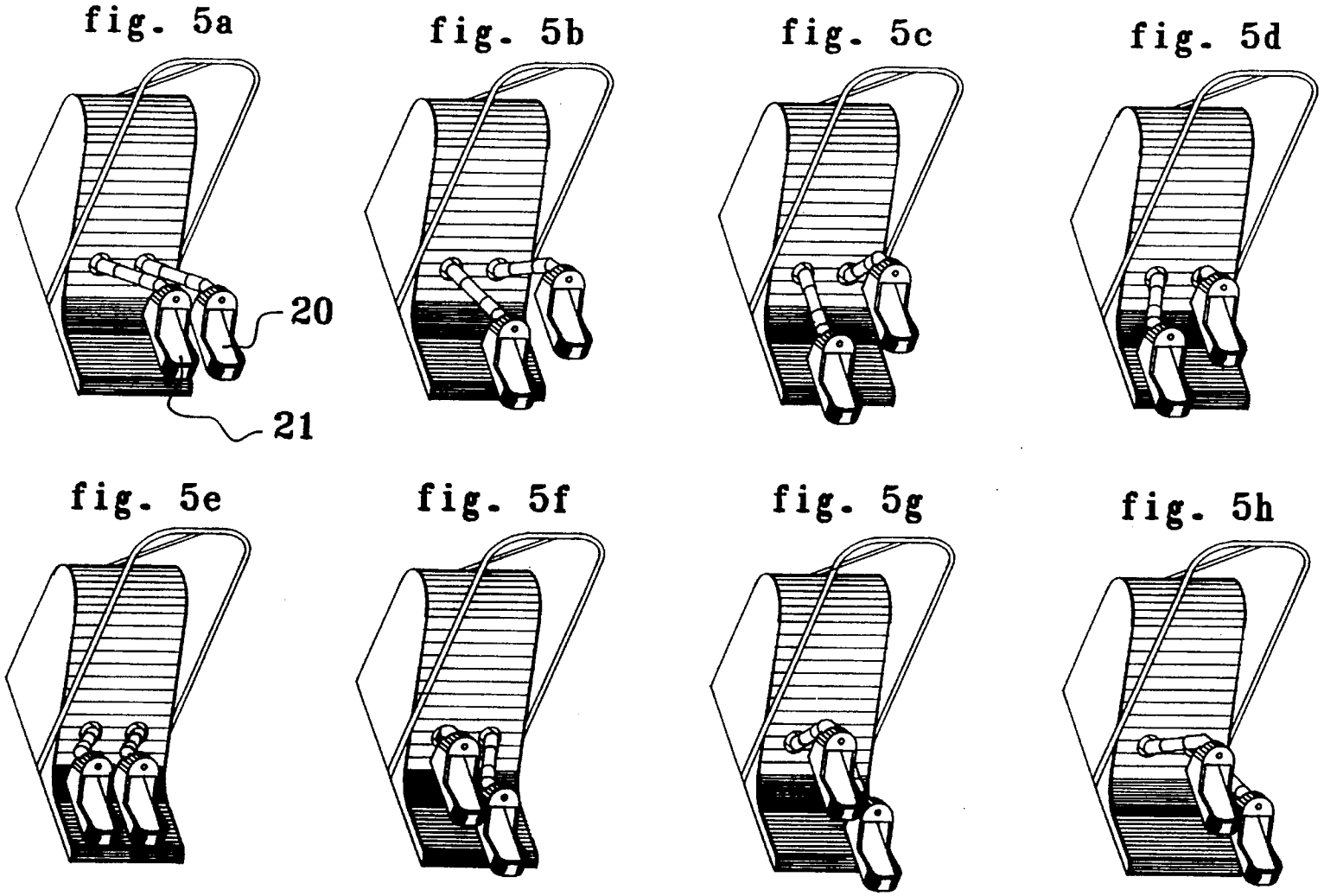
FIG. 5 is a series of front perspective views of the assembled machine of FIG. 1 illustrating the foot platforms as they are successively moved along their counter rotating circular paths in increments of forty-five degrees.

Referring now to FIG. 5A through FIG. 5H, front perspective views are shown of the machine as the right foot platform and left foot platform 20 and 21 respectively, are moved along their counter rotational circular travel paths in increments of forty-five degrees. Starting with FIG. 5A, both foot platforms are oriented at the three o'clock position. FIG. 5B shows the right foot platform at the one thirty o'clock position, while the left foot platform is shown at the four thirty o'clock position. FIG. 5C illustrates the right foot platform at the twelve o'clock position or at zero degrees, while the left foot platform has moved 180 degrees to the six o'clock position. Referring now to FIG. 5D, the right foot platform has moved to the ten thirty o'clock position, and the left foot platform has moved to the seven thirty o'clock position. Continuing now with FIG. 5E, both foot platforms are oriented at the nine o'clock position or at 270 degrees. Directing attention now to FIG. 5F, and counter rotating the foot platforms along their respective circular paths an additional forty-five degrees, we have the right foot platform shown at the seven thirty o'clock position, while the left foot platform is shown at the ten thirty o'clock position. Referring now to FIG. 5G, the right foot platform has moved to the six o'clock position, while the left foot platform has moved to the twelve o'clock position, and concluding at FIG. 5H where the right foot platform is positioned at the four thirty-o'clock position, and the left foot platform has moved to the one thirty o'clock position, at which point the cycle is about to repeat. It is significant to note, from a desirable operational characteristic, that at all times throughout this cycle, the traverse distance between the foot platforms remains constant.

Figure 4:
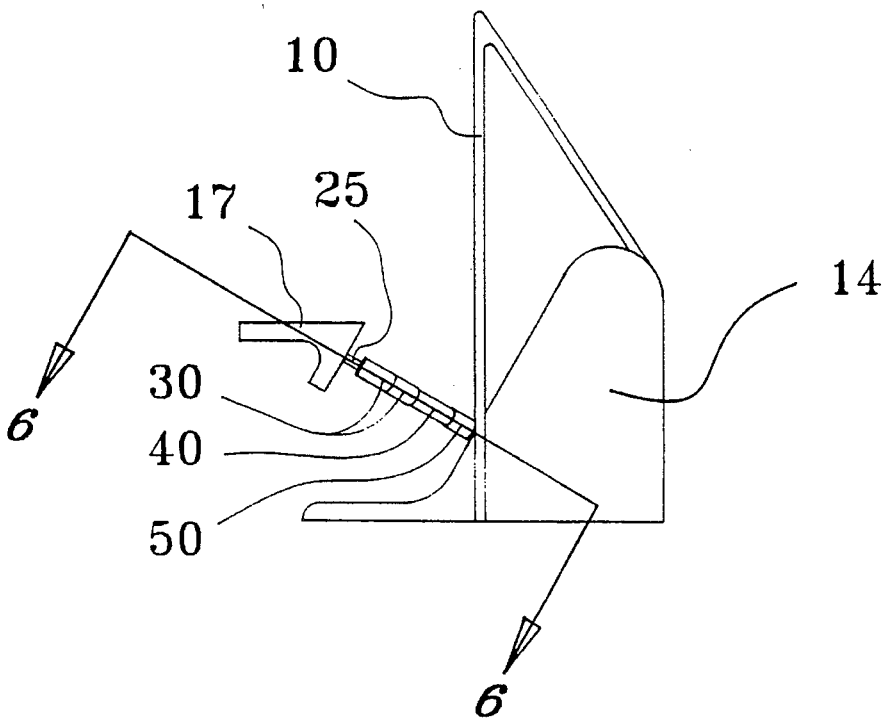
FIG. 4 is a side plan view of the assembled machine of FIG. 1, but is shown with foot platforms of a different design in which the foot contact areas of the foot platforms are located above the foot platform rotational axis with respect to gravity. Both foot platforms in this figure are positioned at the three o'clock position.
Figure 6:
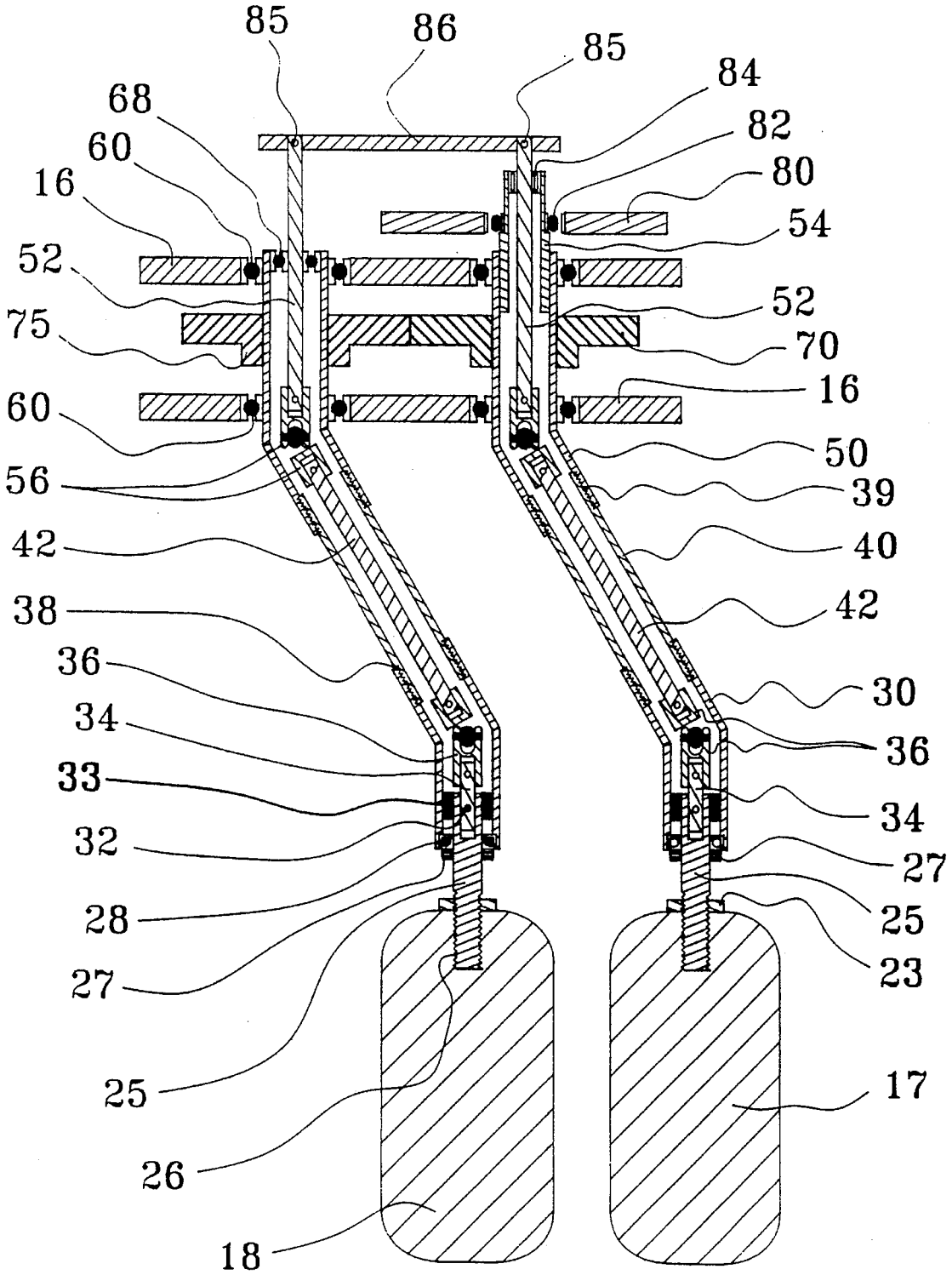
FIG. 6 shows a cross section of the mechanism taken along line 6—6 in FIG. 4 that utilizes shafting and u-joints within a platform support member.

Directing attention now to FIG. 6, a cross sectional view is shown taken along section line 6—6 in FIG. 4. Right and left foot platforms 17 and 18 respectively are threaded at foot platform threads 26 to receive foot platform shaft 25. Foot platform shaft 25, although allowed to travel along the circular path of the foot platforms, does not rotate about its own longitudinal axis with respect to the stationary machine frame, and thus always maintains constant rotational orientation relative to the frame or housing of the machine. The outer distal end of outer tubular elbow 30 has a combination roller and thrust bearing 28 pressed thereupon. Shaft collar 27 locks the inner race of thrust bearing 28 to foot platform shaft 25. Fixed to foot platform shaft 25 by foot platform shaft pin 32 is outer synchro shaft 34. Foot platform shaft needle bearing 33 provides additional radial support during the cantilevered load applied to the foot platforms during machine operation. Outer U-joint 36 is pinned to outer synchro shaft 34, and is also pinned to intermediate synchro shaft 42. Intermediate tube 40 is threaded to outer tubular elbow 30 at outer end thread interface 38, and is also threaded to inner tubular elbow 50 at inner end thread interface 39. Intermediate synchro shaft 42 is connected to inner synchro shaft 52 at inner U-joint 56. Typically, a standard u-joint is suitable for an angular misalignment of thirty degrees, but if more severe misalignment is desired, double u-joints may be advisable. Also note that this figure depicts the correct installation orientation of u-joints when utilized for this type of application in that the connecting shafts are in the same plane and the joints are arranged to operate at equal angles with the bearing pins of the yokes on the intermediate shaft 42 in line with each other.

Continuing with FIG. 6, frame structural member 16 secures tube support bearings 60 at each proximate side of the pair of counter rotating gears 70. Inner synchro shafts 52 are fixed to stationary bar 86 by bar pins 85. Sleeve hub 54 is pressed into inner distal end of right inner tubular elbow 50 to support a one way overrunning clutch 82 of flywheel drive pulley 80. Inner synchro shafts 52 are guided out of inner tubular elbows 50 on the right at inner synchro needle bearing 84, and on the left at inner synchro ball roller bearing 68.

Figure 7:
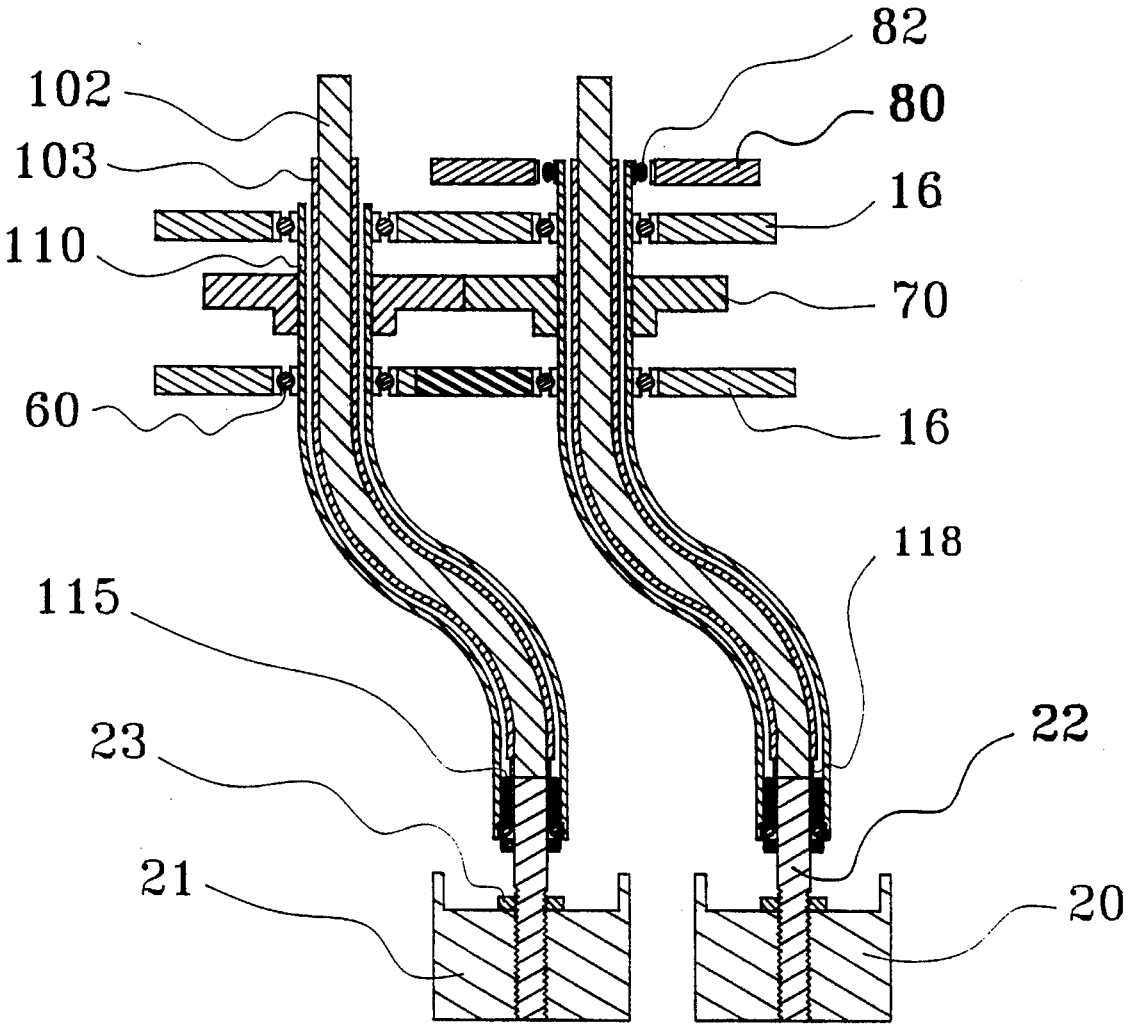
FIG. 7 illustrates a cross section of a platform support member which utilizes drive cable to maintain constant orientation of the foot platforms shown in FIG. 1.

Referring now to FIG. 7, a cross sectional view of a tubular support member is shown which utilizes flexible cable as the foot platform orienting member. Right and left foot platforms 20 and 21 respectively are of the design illustrated in figure one. Foot platform tubular support members 110 each have two sweeping bends which result in the inner and outer distal ends of each of the tubular support members to become offset and parallel. Flexible cable 102 is secured to foot platform shaft 22 at sleeve 118. Sleeve needle bearing 115 provides additional support for foot platform shaft 22. Frame 16 houses tubular support bearings 60, and the overrunning clutch bearing 82 allows the flywheel drive pulley 80 to free wheel in one direction thus permitting the operator to cease motion while the optional flywheel coasts to a gradual stop. Counter rotating gears 70 are secured to tubular support member 110 by a press fit, or by the utilization of set screws, eccentric collars, and the like. In order to provide for the smoothest operation, cable coating 103 may be provided wherever the cable is in contact with the interior surface of rotating tubular support member 110. The selection of the foot platforms 20 and 21, which have rotational axes above the foot contact area with respect to gravity, minimize operation difficulties which may be experienced due to windup of the cable as caused by torsion.

Figure 8:
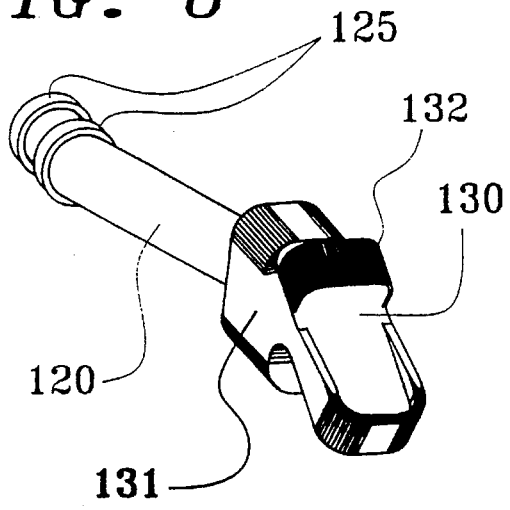
FIG. 8 shows a perspective view of a foot platform and foot platform support member.

Directing attention now to FIG. 8, a platform support member with an accompanying foot platform is shown in a perspective view. Tubular member 120 has a pair of needle bearings 125 at each distal end, and are housed at the inner distal end within a machine frame structural member, and at the outer distal end within foot platform 130 inner shroud 131. Foot platform 130 also has incorporated upon it a top foot loop 132 to assist in maintaining foot placement onto the foot platform.

Figure 9:
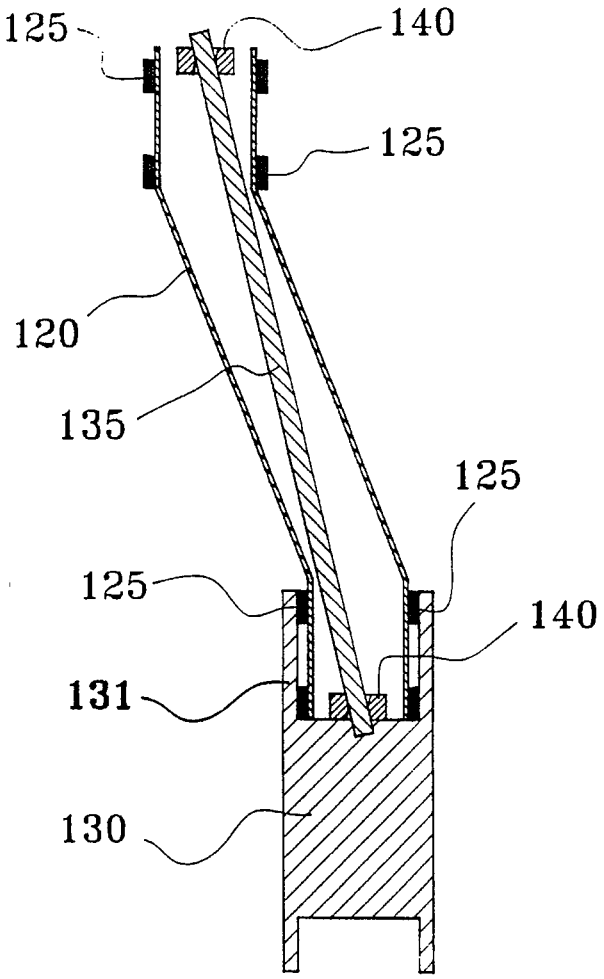
FIG. 9 shows a cross section of the foot platform and foot platform support member of FIG. 8 that utilizes a square cross sectioned rigid bar in conjunction with two rocker joints, as the foot platform orientation member.

Referring now to FIG. 9, a cross section of the assembly shown in FIG. 8 is illustrated. Tubular member 120 is rotatably supported at its inner end with needle bearings 125, and rotatably supports the foot platform 130 at inner shroud 131. Rocker joint 140 is a unique design which will receive and allow angular misalignment of a square profiled foot platform orientation shaft 135 in order to maintain constant orientation of the foot platform 130. The rocker joint 140 in proximity to the inner end of tubular member 120 is nonrotatably attached to a machine stationary structural member or the machine frame, and the rocker joint in proximity to the outer end of tubular member 120 is nonrotatably attached to the foot platform 130, thus the foot platform will maintain constant rotational orientation with respect to the machine frame as the foot platform rotates and travels along its circular path.

Figure 10:
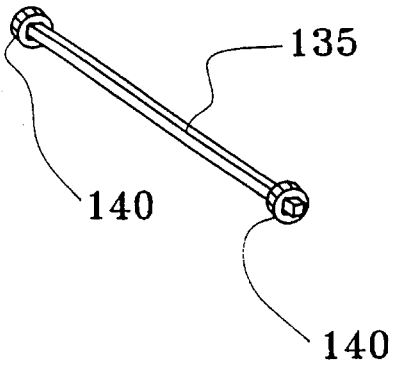
FIG. 10 shows a perspective view of the square profiled, rigid foot platform orientation bar with its accompanying rocker joints.

Continuing, and directing attention now to FIG. 10, the square profiled foot platform orientation shaft 135 is shown engaged with rocker joints 140 at each distal end, and is shown passing through each of the rocker joints during the design angular misalignment of thirty degrees. The incorporation of a polygonal cross sectioned orientation shaft enables the rocker joints to be of a compact design; however, due to the use of a rigid bar as the orientation shaft, the internal diameter of the platform support member is dictated by geometrical considerations as the shaft pivots about its inner end within the platform support member's tubular bends. By so enlarging the internal diameter of these foot platform support members, manufacturing costs can be reduced because each support member need not be a threaded assembly.

Figure 11:
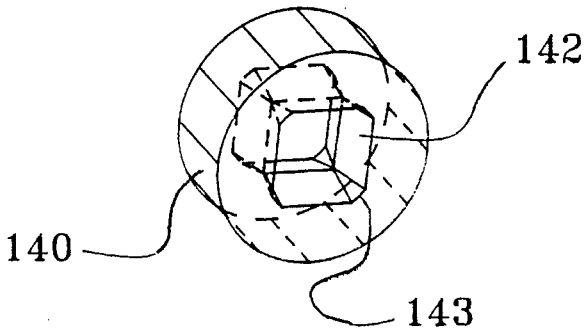
FIG. 11 shows an enlarged perspective view of the rocker joint(s) illustrated in FIG. 8 and FIG. 10.

Referring now to the rocker joint 140 illustrated in FIG. 11, the tapered surface 142 is oriented at an angle of thirty degrees with respect to the longitudinal axis of the joint. This will allow thirty degrees of angular misalignment with the square profiled orientation shaft. Arcuate edge 143 is circular in definition as viewed in the direction of the longitudinal axis of the joint.

Figure 12:
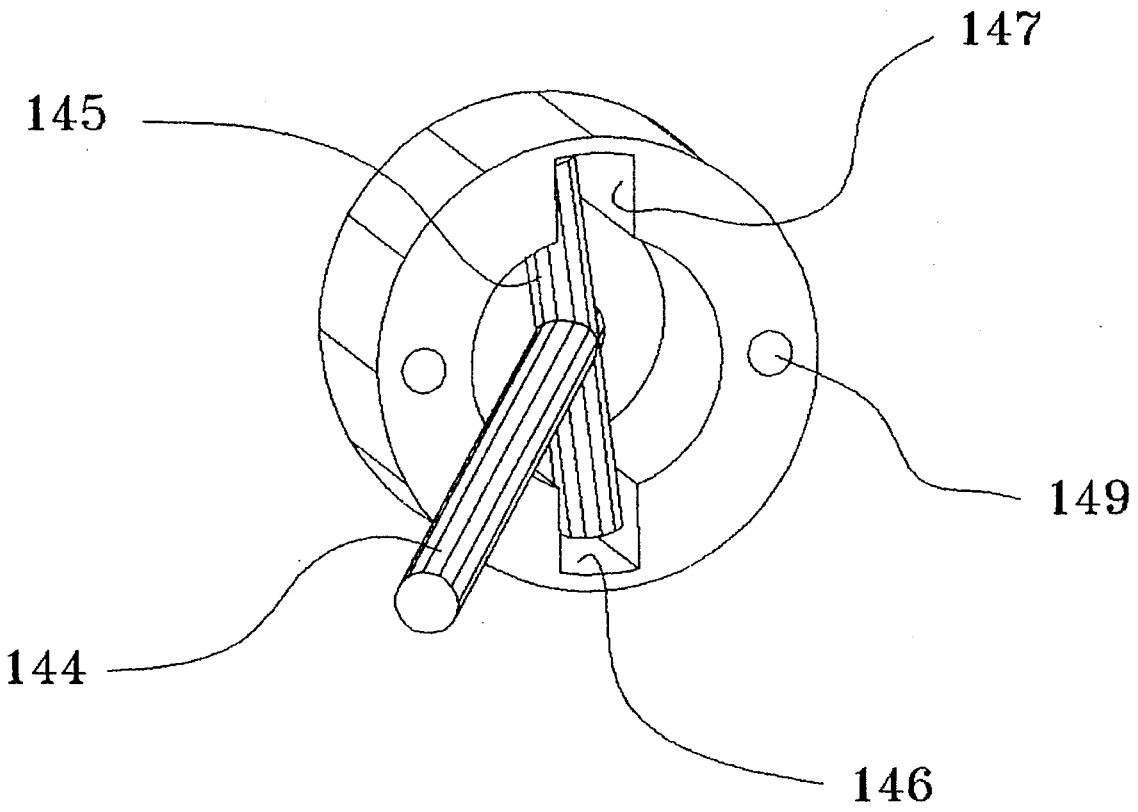
FIG. 12 shows an enlarged perspective view of a portion of a foot platform orientation member which performs a similar function as the rigid bar and rocker joint of FIG. 10 and FIG. 11.

Continuing now with FIG. 12, an alternative design of the torque transmitting elements at one distal end of the orientation member is illustrated in an enlarged perspective view. This design is similar to constant velocity (CV) joints used in the automotive industry and may be one of the preferred versions due to low manufacturing expense. Foot platform orientation shaft 144 transmits torque to the foot platform at the shaft distal end at cross piece 145. Cross piece 145, arbitrarily shown configured as a 'T', as opposed to a triadic or quadripartite arrangement, is nonrotatably connected to foot platform orientation shaft 144, and forcibly engages cup groove side 147 while performing its function of maintaining constant orientation of the foot platforms. Foot platform orientation shaft 144 does not rotate about its own longitudinal axis, although it is allowed of course to pivot in proximity to its inner distal end as the foot platform travels along its circular path. Cup groove bottom 146 may be allowed to make sliding contact with cross piece 145. In order to nonrotatably secure the cup or torque receiving member to a foot platform, bolt holes 149 may be provided.

It should be noted that alternative designs may be substituted for the designs illustrating the foot platform orientation members. One such design, which would accomplish the same result, would be to employ an oval or noncircular shaft member, which would be received by an oval or noncircular female joint suitably chamfered to allow the designed shaft angular misalignment. Another such design which may be favored due to low manufacturing cost would involve longitudinally slotting the shaft at a distal end, and loosely passing through it a torque pin secured rigidly to the interior walls of a collar or sleeve (or torque receiving member) into which the slotted shaft end is inserted. Because multiple designs of the foot platform orientation member are thereby possible, only four of such are illustrated.

Figure 13:
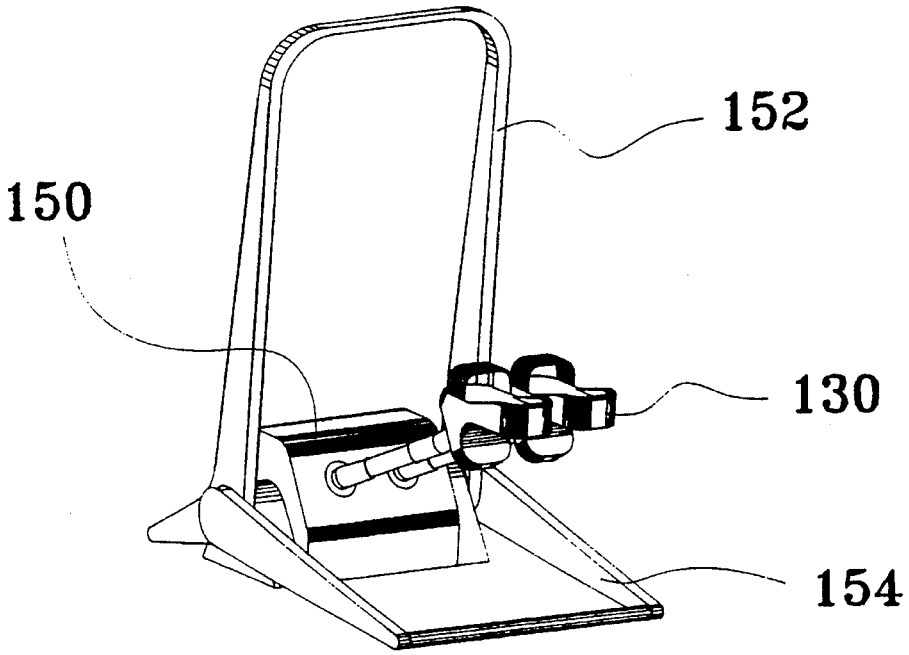
FIG. 13 shows a perspective view of a collapsible version of this invention and is shown deployed in its operational state.

Directing attention now to FIG. 13, a perspective view is illustrated, operationally deployed, of a collapsible design of this invention. Base frame 154 is locked to housing 150 in the downward position, and handle bar 152 is locked in the upward position. Foot platforms 130 are oriented to the three o'clock position. If desired, frictional resisting means and a mechanical flywheel, or simply an electronic flywheel, may easily be incorporated within the physical constraints of housing 158.

Figure 14:
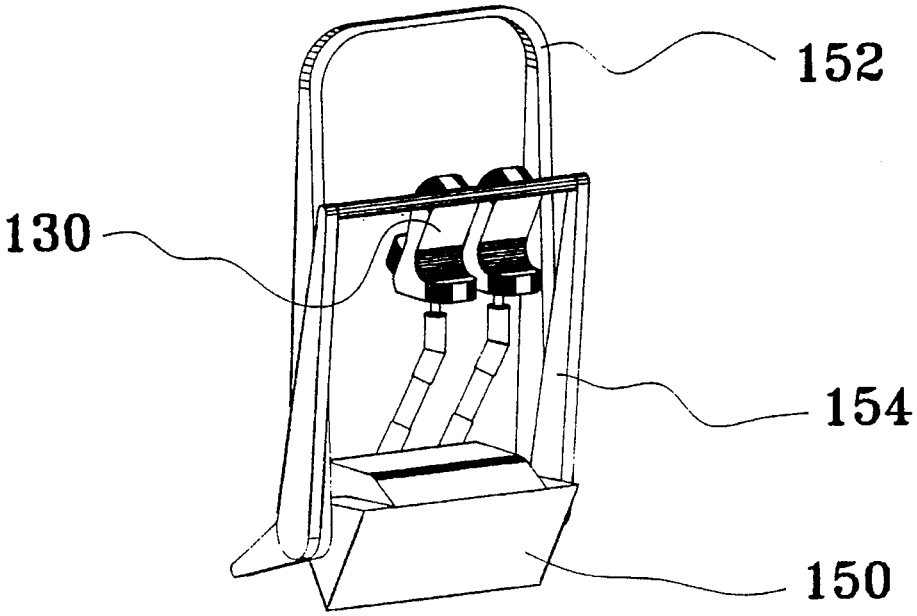
FIG. 14 shows a perspective view of a collapsible version of this invention shown collapsed for portable storage.

Referring to FIG. 14, a perspective view of the collapsible embodiment is shown collapsed for storage or portability. Prior to collapsing, the foot platforms 130 are oriented to the three o'clock position (or nine o'clock position), and then the handle bar 152 is folded down to a stop. The base frame 154 may in turn be pivoted up to its stop, and then all three components locked together to facilitate transport or storage.

Figure 15:
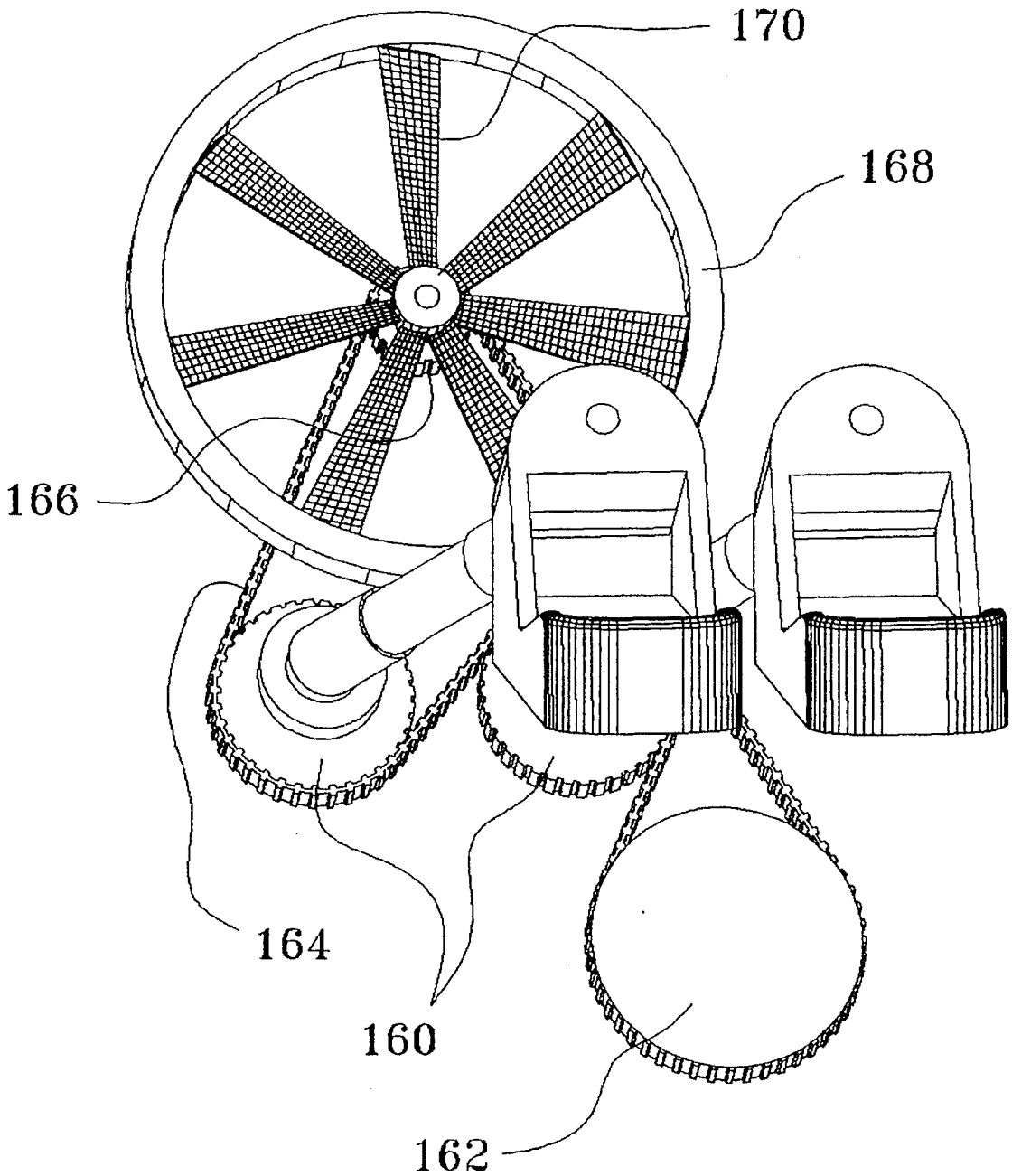
FIG. 15 is a frontal perspective view of another embodiment of the assembly mechanism removed from the housing of the machine, and includes sprockets to maintain synchronous counter rotational motion of the platform support members, and is also shown utilizing a combination fan/flywheel for the force resisting component.

Directing attention now finally to FIG. 15, an embodiment is illustrated which shows some of the mechanics if sprockets (or toothed pulleys or toothed wheels) with an accompanying flexible, endless component such as a timing belt or roller chain is utilized. It may be noted that employing a belt as the counter rotational ensuring element readily enables the center line spacing of the sprockets to be adjusted, and thus by also providing adjustability of the length of the platform support members, the theoretical 'three degrees of freedom' is more closely approximated. Continuing with FIG. 15, double sided timing belt 164 will engage around sprockets 160 such that counter rotation of the pulleys occurs. Idle pulley 162, illustrated with side flanges to prevent the belt from 'walking off', need not have teeth present; and establishes a noninterfering route of the timing belt to the flywheel/fan pulley 166. The combination flywheel/fan provides both the characteristic angular momentum of a flywheel due to the weighted circumference 168, and the movement of air during rotation at fan blades 170. It may be of interest that the inherent design of this machine uniquely lends itself for the installation of a fan which is directed toward the operator, a distinction from other categories of exercise machines which utilize a fan for the motion resisting component. If additional rotational resistance is desired, an adjustable band brake may be installed to tighten against the weighted circumference 168. As indicated earlier, a roller chain may be substituted for a timing belt, and routed about sprockets secured to each platform support member in much the same manner. Some other less well known analogous components involve gear drive chains, gear drive belts, cable chain, synchronous cable with synchronous cable pulleys, and 3-D belt with 3-D pulleys.

Counter rotation of the platform support members could also be ensured by incorporating complicated epicyclic gearing (a gear system involving planetary and sun gears), or tapered gears in order to establish the path in which each of the foot platforms travel along to lie in separate, inclined planes with respect to each other. In the latter case, the rotational axes of the tubular support members would be nonparallel. Also, in discussing additional coupling means to ensure counter rotation of the two platform support members, a multiple link system, with its accompanying cranks and rocking arms, may be utilized which gould offer both durability and quiet operation.

It should be reemphasized that mechanical synchronization of the platform support members, although highly desirable, is not absolutely mandatory, therefore enabling the employment of additional flexible, endless components such as toothless flat belts, V-belts, diamond cross sectioned profiled belts; or even round belts which in the latter case may be allowed to cross between pulleys.

This concludes the description of the invention, and while the above description contains many specificities, these should not be construed as limitations on the scope of the invention, but rather as an exemplification of several of the preferred embodiments there of. Accordingly, the scope of the invention should not only be determined by the text discussion and the embodiments illustrated, but also by the appended claims and their legal equivalents.

I claim:

1. A step type exercise machine comprising:

(a) a frame, (b) said frame having a forward and rearward direction, (c) said frame having a horizontal transverse direction generally perpendicular to said frame forward and rearward direction.

(d) a first foot platform support member rotatably mounted to said frame at a first foot platform support member inner end, (e) a first foot platform support member rotational axis about which said first foot platform support member rotates, (f) said first foot platform support member rotation axis being perpendicular to said frame transverse direction, (g) a second foot platform support member rotatably mounted to said frame at a second foot platform support member inner end, (h) a second foot platform support member rotational axis about which said second foot platform support member rotates, (i) said second foot platform support member rotation axis being perpendicular to said frame transverse direction, (j) said first foot platform support member rotational axis and said second foot platform support member rotational axis being substantially parallel and spaced apart transversely with respect to said machine frame, (k) a first foot platform support member outer end, (l) a second foot platform support member outer end, (m) said first foot platform support member outer end having a first foot platform support member outer end axis being offset and parallel from said first foot platform rotational axis, (n) said second foot platform support member outer end having a second foot platform support member outer end axis being offset and parallel from said second foot platform rotational axis, (o) means rotatably connecting said first foot platform support member to said second foot platform support member, (p) said means rotatably connecting said first foot platform support member to said second foot platform support member such that said first foot platform support member and said second foot platform support member are always caused to counter rotate at approximately the same angular velocity, (q) a first foot platform rotatably connected to said first foot platform support member outer end and having a first foot platform rotational axis coaxial with said first foot platform support member outer end axis, (r) a second foot platform rotatably connected to said second foot platform support member outer end and having a second foot platform support member rotational axis coaxial with said second foot platform support member outer end axis.

2. The apparatus of claim 1, wherein said means rotatably connecting said first foot platform support member to said second foot platform support member includes a first toothed wheel sleeved rigidly to said first loot platform support member inner end, and a second toothed wheel sleeved rigidly to said second foot platform support member inner end, a first toothed wheel rotational axis of said first toothed wheel being coaxial with said first foot platform support member rotational axis, and a second toothed wheel rotational axis of said second toothed wheel being coaxial with said second foot platform support member rotational axis, whereas rotation of said first toothed wheel causes an equal and opposite rotation of the said second toothed wheel.

3. The apparatus of claim 2, wherein said toothed wheels mutually engage.

4. The apparatus of claim 2, wherein said toothed wheels are rotatably connected by an endless flexible member.

5. The apparatus of claim 3, including a first foot platform orientation member nonrotatably connected to said first foot platform, and a second foot platform orientation member nonrotatably connected to said second foot platform, said first and said second foot platform orientation members each having a longitudinal axis and means provided to prevent said foot platform orientation members from rotating about their respective longitudinal axes.

6. The apparatus of claim 4, including a first foot platform orientation member nonrotatably connected to said first foot platform, and a second foot platform orientation member nonrotatably connected to said second foot platform, said first and said second foot platform orientation members each having a longitudinal axis and means provided to prevent said foot platform orientation members from rotating about their respective longitudinal axes.

7. The apparatus of claim 5, wherein said foot platform orientation members are comprised of one or more shaft lengths, and one or more universal joints nonrotatably connected to said shaft lengths.

8. The apparatus of claim 5, wherein said foot platform orientation members comprises:

(a) a shaft, (b) a torque receiving member positioned in proximity to each distal end of said shaft, (c) means to transmit torque between said shaft and said torque receiving member.

9. The apparatus of claim 6, wherein said platform orientation members are comprised of one or more shall lengths, and one or more universal joints nonrotatably connected to said shaft lengths.

10. The apparatus of claim 6, wherein said foot platform orientation members comprises:

(a) a shaft, (b) a torque receiving member positioned in proximity to each distal end of said shaft, (c) means to transmit torque between said shall and said torque receiving member.

11. A step type exercise machine comprising:

(a) a frame, (b) said frame having a forward and rearward direction, (c) said frame having a horizontal transverse direction generally perpendicular to said frame forward and rearward direction, (d) a first foot platform support member rotatably mounted to said frame at a first foot platform support member inner end, (e) a first foot platform support member rotational axis about which said first foot platform support member rotates, (f) said first foot platform support member rotation axis being perpendicular to said frame transverse direction, (g) a second foot platform support member rotatably mounted to said frame at a second foot platform support member inner end, (h) a second foot platform support member rotational axis about which said second foot platform support member rotates, (i) said second foot platform support member rotation axis being perpendicular to said frame transverse direction, (j) said first foot platform support member rotational axis and said second foot platform support member rotational axis being substantially parallel and spaced apart transversely with respect to said machine frame, (k) a first foot platform support member outer end, (l) a second foot platform support member outer end, (m) said first foot platform support member outer end having a first foot platform support member outer end axis being offset and parallel from said first foot platform rotational axis, (n) said second foot platform support member outer end having a second foot platform support member outer end axis being offset and parallel from said second foot platform rotational axis, (o) means rotatably connecting said first foot platform support member to said second foot platform support member, (p) said means rotatably connecting said first foot platform support member to said second foot platform support member such that said first foot platform support member and said second foot platform support member are always caused to counter rotate at approximately the same angular velocity, (q) a first foot platform rotatably connected to said first foot platform support member outer end and having a first foot platform rotational axis coaxial with said first foot platform support member outer end axis, (r) a second foot platform rotatably connected to said second foot platform support member outer end and having a second foot platform support member rotational axis coaxial with said second foot platform support member outer end axis, (s) said means rotatably connecting said first foot platform support member to said second foot platform support member includes a first toothed wheel sleeved rigidly to said first foot platform support member inner end, and a second toothed wheel sleeved rigidly to said second foot platform support member inner end, a first toothed wheel rotational axis of said first toothed wheel being coaxial with said first foot platform support member rotational axis, and a second toothed wheel rotational axis of said second toothed wheel being coaxial with said second foot platform support member rotational axis, whereas rotation of said first toothed wheel causes an equal and opposite rotation of the said second toothed wheel wherein said first and said second toothed wheels mutually engage.

12. The apparatus of claim 11, including a first foot platform orientation member nonrotatably connected to said first foot platform, and a second foot platform orientation member nonrotatably connected to said second foot platform, said first and said second foot platform orientation members each having a longitudinal axis and means provided to prevent said foot platform orientation members from rotating about their respective longitudinal axes.

13. The apparatus of claim 12, wherein said means rotatably connecting said first foot platform support member to said second foot platform support member causes said first foot platform support member and said second foot platform support member rotate out of phase approximately 180 degrees with respect to each other, such that at one instant, as said first foot platform is located approximately at zero degrees relative to a stationary reference frame, said second foot platform is located approximately 180 degrees relative to the same stationary reference frame.

14. The apparatus of claim 13, wherein said foot platform orientation members are comprised of one or more shaft lengths, and one or more universal joints nonrotatably connected to said shaft lengths.

15. The apparatus of claim 13, wherein said foot platform orientation members comprises:

(a) a shaft, (b) a torque receiving member positioned in proximity to each distal end of said shaft, (c) means to transmit torque between said shaft and said torque receiving member.

16. A step type exercise machine comprising:

(a) a frame, (b) said frame having a forward and rearward direction, (c) said frame having a horizontal transverse direction generally perpendicular to said frame forward and rearward direction, (d) a first foot platform support member rotatably mounted to said frame at a first foot platform support member inner end, (e) a first foot platform support member rotational axis about which said first foot platform support member rotates, (f) said first foot platform support member rotation axis being perpendicular to said frame transverse direction, (g) a second foot platform support member rotatably mounted to said frame at a second foot platform support member inner end, (h) a second foot platform support member rotational axis about which said second foot platform support member rotates, (i) said second foot platform support member rotation axis being perpendicular to said frame transverse direction, (j) said first foot platform support member rotational axis and said second foot platform support member rotational axis being substantially parallel and spaced apart transversely with respect to said machine frame, (k) a first foot platform support member outer end, (l) a second foot platform support member outer end, (m) said first foot platform support member outer end having a first foot platform support member outer end axis being offset and parallel from said first foot platform rotational axis, (n) said second foot platform support member outer end having a second foot platform support member outer end axis being offset and parallel from said second foot platform rotational axis, (o) means rotatably connecting said first foot platform support member to said second foot platform support member, (p) said means rotatably connecting said first foot platform support member to said second foot platform support member such that said first foot platform support member and said second foot platform support member are always caused to counter rotate at approximately the same angular velocity, (q) a first foot platform rotatably connected to said first foot platform support member outer end and having a first foot platform rotational axis coaxial with said first foot platform support member outer end axis, (r) a second foot platform rotatably connected to said second foot platform support member outer end and having a second foot platform support member rotational axis coaxial with said second foot platform support member outer end axis, (s) said means rotatably connecting said first foot platform support member to said second foot platform support member includes a first toothed wheel sleeved rigidly to said first foot platform support member inner end, and a second toothed wheel sleeved rigidly to said second foot platform support member inner end, a first toothed wheel rotational axis of said first toothed wheel being coaxial with said first foot platform support member rotational axis, and a second toothed wheel rotational axis of said second toothed wheel being coaxial with said second foot platform support member rotational axis, whereas rotation of said first toothed wheel causes an equal and opposite rotation of the said second toothed wheel wherein said first and said second toothed wheels are rotatably connected by an endless flexible member.

17. The apparatus of claim 16, including a first foot platform orientation member nonrotatably connected to said first foot platform, and a second foot platform orientation member nonrotatably connected to said second foot platform, said first and said second foot platform orientation members each having a longitudinal axis and means provided to prevent said foot platform orientation members from rotating about their respective longitudinal axes.

18. The apparatus of claim 17, wherein said means rotatably connecting said first foot platform support member to said second foot platform support member causes said first foot platform support member and said second foot platform support member rotate out of phase approximately 180 degrees with respect to each other, such that at one instant, as said first foot platform is located approximately at zero degrees relative to a stationary reference frame, said second foot platform is located approximately 180 degrees relative to the same stationary reference frame.

19. The apparatus of claim 18, wherein said foot platform orientation members are comprised of one or more shaft lengths, and one or more universal joints nonrotatably connected to said shaft lengths.

20. The apparatus of claim 19, wherein said foot platform orientation members comprises:

(a) a shaft, (b) a torque receiving member positioned in proximity to each distal end of said shaft, (c) means to transmit torque between said shaft and said torque receiving member.

* * * * *